US010690133B2

(12) United States Patent
Panno

(10) Patent No.: US 10,690,133 B2
(45) Date of Patent: Jun. 23, 2020

(54) GEAR PUMP AND METHOD FOR REALISING IT

(71) Applicant: CASAPPA S..P.A., Collecchio (Parma) (IT)

(72) Inventor: Alessandro Panno, Parma (IT)

(73) Assignee: CASAPPA S.P.A., Collecchio (IT)

( * ) Notice: Subject to any disclaimer, the term of this patent is extended or adjusted under 35 U.S.C. 154(b) by 169 days.

(21) Appl. No.: 15/572,429

(22) PCT Filed: May 12, 2016

(86) PCT No.: PCT/IB2016/052725
§ 371 (c)(1),
(2) Date: Nov. 7, 2017

(87) PCT Pub. No.: WO2016/185329
PCT Pub. Date: Nov. 24, 2016

(65) Prior Publication Data

US 2018/0119695 A1 May 3, 2018

(30) Foreign Application Priority Data

May 20, 2015 (IT) ..... 102015000016193

(51) Int. Cl.

| | |
|---|---|
| ***F04B 39/00*** | (2006.01) |
| ***F04B 11/00*** | (2006.01) |
| ***F04C 2/10*** | (2006.01) |
| ***F04C 2/08*** | (2006.01) |
| ***F04B 53/16*** | (2006.01) |
| ***F04C 29/06*** | (2006.01) |

(Continued)

(52) U.S. Cl.
CPC ..... *F04C 2/10* (2013.01); *F04C 2/086* (2013.01); *F04C 2/12* (2013.01); *F04C 15/06* (2013.01); *F04C 15/064* (2013.01); *F04C 2230/21* (2013.01); *F04C 2240/30* (2013.01); *F04C 2250/101* (2013.01); *F04C 2250/102* (2013.01)

(58) Field of Classification Search
CPC .... F04C 2/10; F04C 2/086; F04C 2/12; F04C 15/064; F04C 2/084; F04C 2/18; F04C 2/102; F04B 39/0055; F04B 11/0091; F04B 39/0027
USPC ..... 418/205, 206.4
See application file for complete search history.

(56) References Cited

U.S. PATENT DOCUMENTS 2,236,980 A * 4/1941 Ungar ..... F04C 2/084 418/73
3,796,523 A 3/1974 Albrecht et al.
(Continued)

FOREIGN PATENT DOCUMENTS

CN 202370833 U 8/2012
CN 103573617 2/2014
(Continued)

*Primary Examiner* — Deming Wan
(74) *Attorney, Agent, or Firm* — Pearne & Gordon LLP

(57) ABSTRACT

A gear pump comprising:—a pair of gears (2) able to interact with a fluid crossing the pump (1);—a housing seating (3) of said pair of gears (2), said housing seating (3) comprising a rest plane (30) of a shim (4);—a delivery conduit (6) which develops from said housing seating (3) and comprising an inlet mouth (60). The inlet mouth (60) of the delivery conduit (6) is at a distance from an intersection (7) between a rest plane (30) of the shim (4) and remaining parts of the housing seating (3).

6 Claims, 3 Drawing Sheets

(51) Int. Cl.

| | |
|---|---|
| ***F04C 29/00*** | (2006.01) |
| ***F04C 15/06*** | (2006.01) |
| ***F04C 2/12*** | (2006.01) |

(56) References Cited

U.S. PATENT DOCUMENTS

| | | | | |
|---|---|---|---|---|
| 7,997,885 | B2 * | 8/2011 | Allum | F04C 18/126 418/189 |
| 8,398,381 | B1 | 3/2013 | Schumann | |
| 9,046,102 | B2 | 6/2015 | Naganuma et al. | |
| 9,309,885 | B2 * | 4/2016 | Blechschmidt | F04C 15/0003 418/178 |
| 2013/0156625 | A1 | 6/2013 | Schumann | |
| 2014/0030132 | A1 | 1/2014 | Naganuma et al. | |
| 2014/0255234 | A1 | 9/2014 | Schumann | |

FOREIGN PATENT DOCUMENTS

| | | |
|---|---|---|
| CN | 203604194 | 5/2014 |
| DE | 102012206699 | 10/2013 |
| JP | H11270469 A | 10/1999 |

* cited by examiner

GEAR PUMP AND METHOD FOR REALISING IT

TECHNICAL FIELD

The present invention relates to a gear pump and a method for realising it.

STATE OF THE ART

Gear pumps are known that comprise a casing internally of which a housing compartment of a pair of cogwheels is provided. The compartment comprises two opposite bases and a lateral wall which develops between the two bases.

The pump further comprises an aspirating conduit and a delivery conduit of the fluid to be treated.

The delivery conduit:

- includes a large passage area with the aim of minimising load losses;
- a mouth which involves an extended zone of the lateral wall and of one of said two bases with the aim of enabling the use of easy geometries for realisation by moulding.

This solution is not free of drawbacks since zones of the seating exhibiting small degrees of curvature and close to the delivery conduit are particularly subject to significant tensions that are responsible for breakages.

AIM OF THE INVENTION

In this context, the technical task that underpins the present invention is to provide a pump and a method that obviate the above-mentioned drawbacks.

In particular, the aim of the present invention is to provide a pump and a method for realising it that improves the reliability of the pump and extends its working life.

The set technical task and the specified aims are substantially attained by a pump and a method for realising it, comprising the technical characteristics set down in one or more of the accompanying claims.

BRIEF DESCRIPTION OF THE DRAWINGS

Further characteristics and advantages of the present invention will more fully emerge from the non-limiting description of a preferred but not exclusive embodiment of a pump and a method for realising it, as illustrated in the accompanying drawings, in which.

DETAILED DESCRIPTION OF PREFERRED EMBODIMENTS OF THE INVENTION

Figure 1:
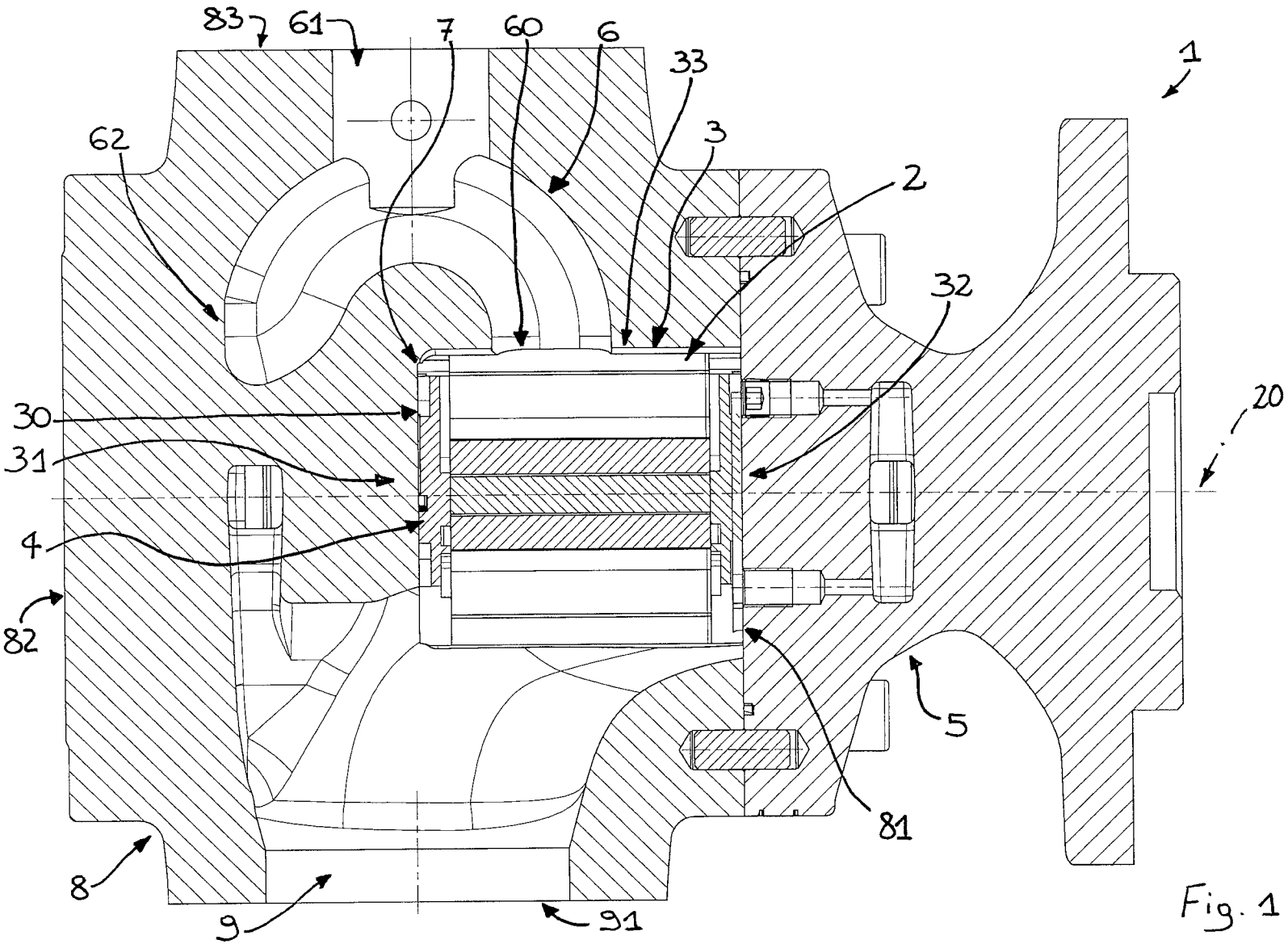
FIG. 1 is a section view of a pump according to the present invention.

In the accompanying figures reference number 1 denotes a gear pump. By "gear pump" is meant a pump which exploits the change of volume caused by the enmeshing of two bodies located in a compartment for causing an aspiration of or a thrust on a fluid. These, in general terms, are however well known in the technical sector. In the preferred embodiment the gears are a pair of cogwheels. The gears might be one with external teeth and the other with internal teeth. More in general, the two cogwheels might be revolving bodies which interact with one another, but do not have the profile of a revolving body (for example a lobe pump).

The pump 1 comprises a pair of gears 2 (preferably cogwheels) reciprocally enmeshing and destined to interact with a fluid crossing the pump 1.

The pump 1 also comprises a housing seating 3 of said gears 2. The housing seating 3 comprises a rest plane 30 of a shim 4.

The shim 4 further enables facilitating the movement of at least one of said gears 2, minimising wear thereon.

The pump 1 comprises an aspirating conduit 9 of the fluid to be treated which opens into the housing seating 3.

The pump 1 further comprises a delivery conduit 6 which develops from said housing seating 3. The delivery conduit 6 comprises an inlet mouth 60. As shown in FIG. 1, the inlet mouth 60 faces said housing seating 3.

The delivery conduit 6 has an arched shape. It is typically C-shaped. The arched shape is very important as it gives maximum flexibility in the positioning of an outlet mouth 61 of the delivery conduit 6 (compare for example FIGS. 2*b* and 4*b*).

The inlet mouth 60 of the delivery conduit 6 is at a distance from an intersection 7 between the rest plane 30 of the shim 4 and remaining parts of the housing seating 3. The rest plane 30 is a plane on at least a portion of which the shim 4 rests.

This enables distancing the delivery conduit 6 and the inlet mouth 60 (on which significant pressures act) from said intersection 7 (which normally has small degrees of curvature which in any case facilitate the concentration of the tensions). In this way the positioning of the greater stresses is prevented from being positioned at zones which by virtue of the geometry thereof induce a concentration of the tensions.

Further, the presence of the delivery conduit 6 at the intersection 7 will be avoided, which delivery conduit 6 normally has a relatively rough surface which therefore might facilitate the appearance of cracks with respect to a surface provided with a better surface finishing. In fact the surfaces contributing to the definition of the intersection 7 will be subject to a surface finishing using machine tools that reduces the roughness thereof and also reduces the risk of cracks appearing.

Figure 2A:
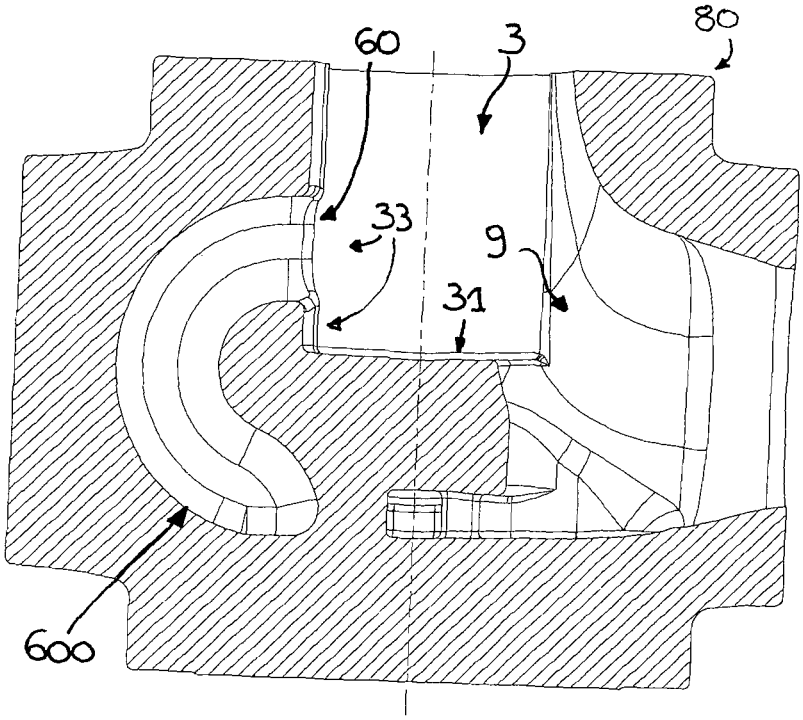
FIGS. 2*a* and 2*b* illustrate section views of some parts of the pump in two distinct moments of the production method.
Figure 2C:
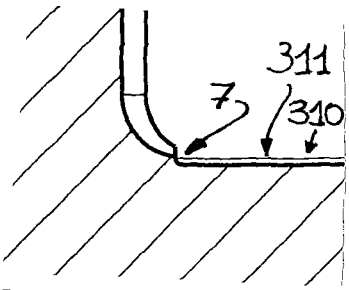
FIG. 2*c* illustrates a detail of FIG. 2*b;*
Figure 3C:
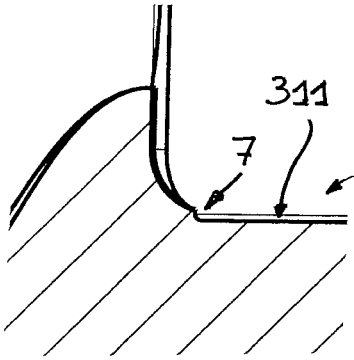
FIG. 3*c* illustrates a detail of FIG. 3*b;*
Figure 4B:
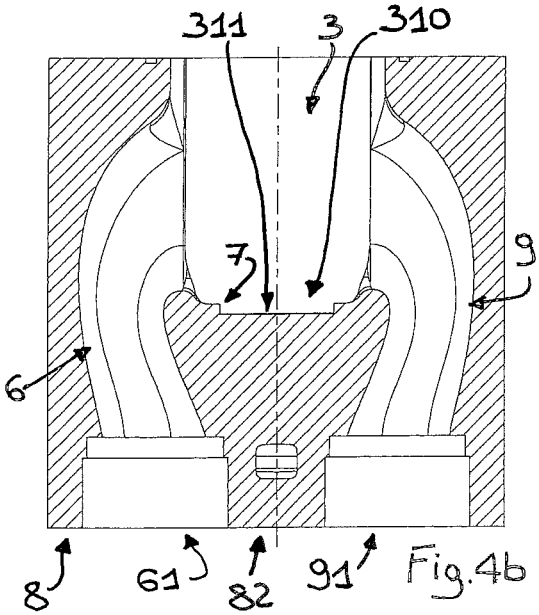
FIGS. 4*a* and 4*b* illustrate section views of some parts of the pump (alternative to those of FIGS. 2*a*, 2*b*, 3*a*, 3*b*) in two distinct moments of the production method.

The housing seating 3 also comprises a first and a second base 31, 32 which develop transversally (preferably perpendicularly) to a direction 20 parallel to the rotation axis of at least one of said gears 2. The first base 31 comprises the rest plane 30 of the shim. As illustrated in FIG. 2*c* or 3*c* or 4*b*, the first base 31 comprises a recess 310 having a bottom 311 defined by said rest plane 30 of the shim 4.

The housing seating 3 comprises a lateral surface 33 interposed between the first and the second base 31, 32. The inlet mouth 60 of the delivery conduit 6 is entirely fashioned in said lateral surface 33.

The minimum distance of the inlet mouth 60 of the delivery conduit 6 of said intersection 7 is preferably greater than 10 millimetres.

The aspirating conduit 9 also opens into said housing seating 3. The aspirating conduit 9 typically opens in said housing seating 3 from an opposite side with respect to the side in which the inlet mouth 60 of the delivery conduit 6 is fashioned.

The pump 1 comprises a cover 5 that defines the second base 32 of the housing seating 3 opposite the first base 31. The cover 5 thus contributes to delimiting the housing seating 3.

The lateral surface 33 and the rest plane 30 of the shim 4 have a surface finish that is better than a surface finish of an initial portion of said delivery conduit 6. The degree of roughness of the lateral surface 33 and the rest plane 30 of the shim 4 is therefore lower than that of an initial portion of said delivery conduit 6. The presence of a surface having a better surface finishing at the intersection 7 contributes to reducing the risk of cracking.

The minimum distance of the inlet mouth 60 from an intersection between a rest plane of any shim and remaining parts of the housing seating 3 is advantageously greater than 0 and preferably greater than 10 millimetres.

The pump 1 comprises a monolithic first body 8 in which the delivery conduit 6 and the aspirating conduit 9 are fashioned and which comprises:

a first surface 81 which overlaps the cover 5;

a second surface 82 which lies on the opposite side (the rear side of the pump) to the side where the first surface 81 is located.

The first body 8 also comprises a lateral surface 83 that connects the first and the second surface 81, 82.

Figure 4A:
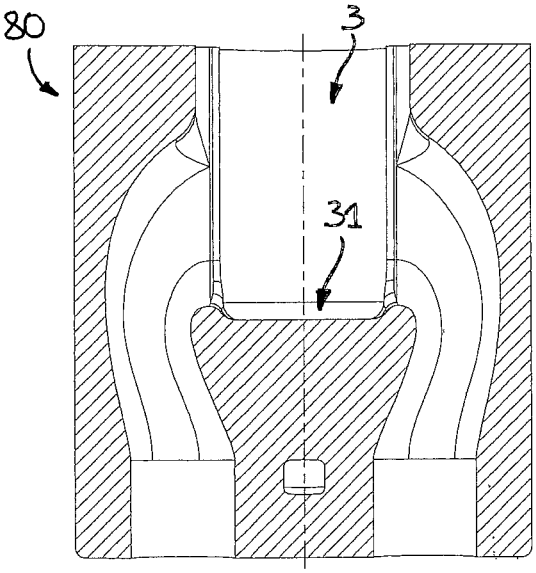

In a constructional solution illustrated in FIG. 4*b*, the delivery conduit 6 and the aspirating conduit 9 respectively comprise an outlet mouth 61 and an inlet mouth 91 which lie on the second surface 82. This solution enables minimising the volumes of the pump 1 perpendicularly to the direction 20 of the rotation axis of at least one of said gears 2 (it is however specified that the two gears are preferably both revolving and have parallel rotation axes). In this regard it is specified that the solution of FIG. 4*a* is relative to the product obtained by moulding, while the solution of FIG. 4*b* illustrates the subsequent machining done using a machine tool.

Figure 3B:
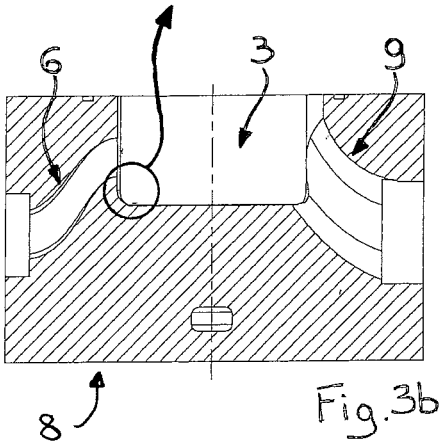
FIGS. 3*a* and 3*b* illustrate section views of some parts of the pump (alternative to those of FIGS. 2*a* and 2*b*) in two distinct moments of the production method.
Figure 3A:
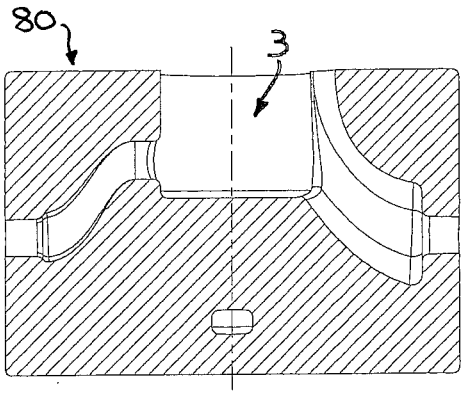

In a constructional solution illustrated in FIG. 3*b*, the delivery conduit 6 and the aspirating conduit 9 respectively comprise an outlet mouth 61 and an inlet mouth 91 which lie on the lateral surface 83. In this regard it is specified that the solution of FIG. 3*a* is relative to the product obtained by moulding, while the solution of FIG. 3*b* illustrates the subsequent machining done using a machine tool.

Figure 2B:
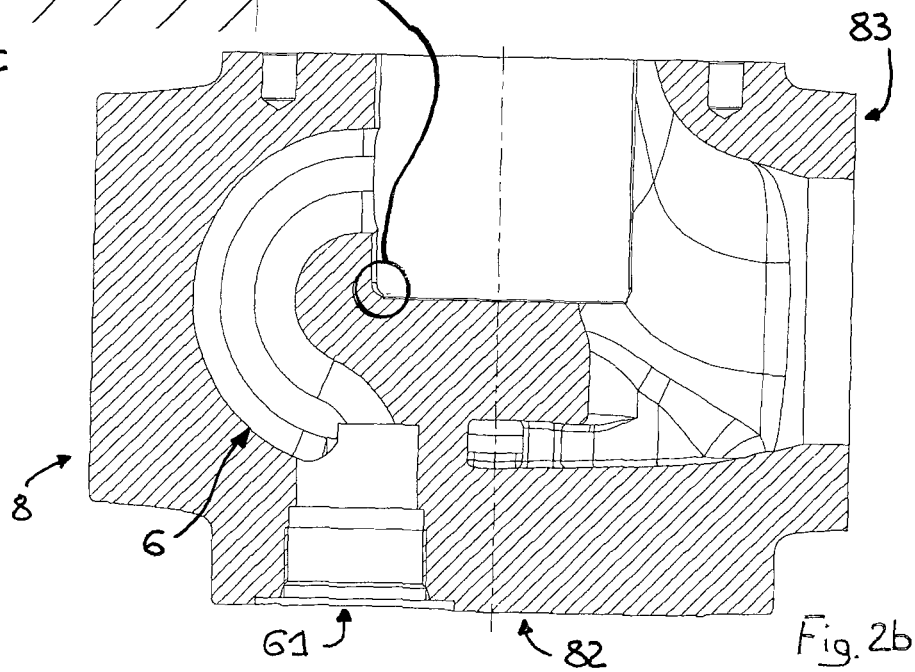

In a constructional solution illustrated in FIG. 2*b*, the delivery conduit 6 and the aspirating conduit 9 respectively comprise:

an outlet mouth 61 which lies on the second surface 82; and an inlet mouth 91 which lies on the lateral surface 83.

In this regard it is specified that the solution of FIG. 2*a* is relative to the product obtained by moulding, while the solution of FIG. 2*b* illustrates the subsequent machining done using a machine tool.

As illustrated by the various constructional solutions described in the foregoing, the outlet mouth 61 imposes on the fluid a theoretical direction of outflow which can be parallel or perpendicular to the direction 20 (which due to the way it is defined is parallel to the rotation axis of at least one of said gears 2).

The present invention further relates to a method for production of gear pump (which advantageously has one or more of the above-described characteristics).

The method comprises a step of realising the first body 8 which at least partly identifies a housing seating 3 of gears 2 destined to interact with a fluid that crosses the pump 1.

The method also includes realising a cover 5 which contributes to delimiting the housing seating 3. The cover 5 is removably connected to the first body 8.

The method advantageously comprises a step of inserting a shim 4 internally of said housing seating 3.

The method further comprises a step of inserting a pair of gears 2 (preferably cogwheels) which reciprocally enmesh internally of said housing seating 3. The shim 4 described in the foregoing prevents the dragging between at least one of said gears and the first body 8.

The step of realising the first body 8 which at least partly identifies the housing seating 3 further comprises a step of realising an arched portion of a delivery conduit 6 which develops from said housing seating 3 with an inlet mouth 60 which:

faces said housing seating 3;

has a minimum distance that is not nil from a rest plane 30 of the shim 4, the rest plane 30 contributing to delimiting the housing seating 3.

The step of realising the first body 8 comprises at least steps of:

i) realising a first rough body 80 by moulding, said first body 80 comprising a first base 31 from which a lateral surface 33 develops in which the inlet mouth 60 of the delivery conduit 6 is fashioned;

ii) carrying out a finishing of said first base 31 and of the lateral surface 33 using a machine tool; the rest plane 30 of the shim 4 being fashioned at the first base 31 by means of a further surface machining using a machine tool.

The step of realising by moulding the first rough body 80 also comprises a step of realising said portion of delivery conduit 6. The delivery conduit 6 is internal of the first body 8.

The cover 5 is preferably made by moulding.

The step of realising by moulding the first rough body 80 also comprises a step of realising an aspirating conduit 9 which conveys the fluid to be treated into the housing seating 3. The aspirating conduit 9 is also internal of the first body 8.

The step of realising said delivery conduit 6 that develops from the housing seating 3 includes realising a blind channel 600 which develops from said inlet mouth 60 up to an end 62 opposite said inlet mouth 60.

The method further comprises a step of realising, using a machine tool, an outlet 61 of the delivery conduit 6 from the first body 8. According to the specific requirements, the outlet 61 of the delivery conduit 6 can be made at different points of the blind channel 600.

In the particular solution illustrated in FIG. 1, the outlet 61 of the delivery conduit 6 intercepts the delivery conduit 6 at a section interposed between the inlet mouth 60 and the opposite end 62.

In an alternative solution (see for example FIG. 2*b*), the outlet 61 is realised at the end 62 opposite the inlet mouth 60 (in this case the theoretical direction of outflow imposed by the outlet 61 to the fluid is advantageously substantially parallel to the rotation axis of the gears 2).

The present invention provides important advantages.

Firstly it enables reducing the tensions on the pump, increasing the reliability and working life of the pump 1.

The invention as it is conceived is susceptible to numerous modifications and variants, all falling within the scope of the inventive concept by which it is characterised. Further, all the details can be replaced with other technicallyequivalent elements. In practice, all the materials used, as well as the dimensions, can be any according to requirements.

The invention claimed is:

1. A method for realising a gear pump, comprising steps of:

i) realising a first body (8) which at least partly identifies a housing seating (3) of a pair of gears (2) able to interact with a fluid crossing the pump (1);

ii) inserting a shim (4) internally of said housing seating (3);

iii) inserting the pair of gears (2) internally of said housing seating (3), said shim (4) preventing contact between at least one of said gears (2) and the first body (8);

characterised in that the step of realising the first body (8) which at least partly identifies the housing seating (3) comprises a step of realising an arched portion of a delivery conduit (6) which develops from said housing seating (3) with an inlet mouth (60) which:

faces said housing seating (3);

has a minimum distance that is not nil from a rest plane (30) of the shim (4), said rest plane (30) contributing to delimiting said housing seating (3);

the step of realising said delivery conduit (6) that develops from the housing seating (3) includes realising a blind channel (600) which develops from said inlet mouth (60) up to an end (62) opposite said inlet mouth (60);

realizing, using a machine tool, an outlet (61) of the delivery conduit (6) from the first body (8);

said outlet (61) of the delivery conduit (6) intercepting said delivery conduit (6) at a section interposed between the inlet mouth (60) and the opposite end (62).

2. The method according to claim 1, characterised in that the step of realising the first body (8) comprises steps of:

realising a first rough body (80) by moulding, said first rough body (80) comprising a first base (31) from which a lateral surface (33) develops in which the inlet mouth (60) of the delivery conduit (6) is fashioned;

carrying out a finishing of said first base (31) and the lateral surface (33) using a second machine tool; said rest plane (30) of the shim (4) being fashioned at the first base (31) by means of a further surface machining using another machine tool.

3. The method according to claim 2, characterised in that the step of realising by moulding the first rough body (80) also comprises a step of realising said arched portion of the delivery conduit (6);

the step of realising by moulding the first rough body (80) also comprising a step of realising an aspirating conduit (9) which conveys the fluid to be treated into the housing seating (3).

4. A method for realising a gear pump, comprising steps of:

i) realising a first body (8) which at least partly identifies a housing seating (3) of a pair of gears (2) able to interact with a fluid crossing the pump (1);

ii) inserting a shim (4) internally of said housing seating (3);

iii) inserting the pair of gears (2) internally of said housing seating (3), said shim (4) preventing contact between at least one of said gears (2) and the first body (8);

characterised in that the step of realising the first body (8) which at least partly identifies the housing seating (3) comprises a step of realising an arched portion of a delivery conduit (6) which develops from said housing seating (3) with an inlet mouth (60) which:

faces said housing seating (3);

has a minimum distance that is not nil from a rest plane (30) of the shim (4), said rest plane (30) contributing to delimiting said housing seating (3);

the step of realising said delivery conduit (6) that develops from the housing seating (3) includes realising a blind channel (600) which develops from said inlet mouth (60) up to an end (62) opposite said inlet mouth (60);

realizing, using a machine tool, an outlet (61) of the delivery conduit (6) from the first body (8);

said outlet (61) of the delivery conduit (6) intercepting said delivery conduit (6) at the end (62) opposite the inlet mouth; a theoretical direction of outlet imposed by the outlet (61) being substantially parallel to the rotation axis of said gears (2).

5. The method according to claim 4, characterised in that the step of realising the first body (8) comprises steps of:

realising a first rough body (80) by moulding, said first rough body (80) comprising a first base (31) from which a lateral surface (33) develops in which the inlet mouth (60) of the delivery conduit (6) is fashioned;

carrying out a finishing of said first base (31) and the lateral surface (33) using a second machine tool; said rest plane (30) of the shim (4) being fashioned at the first base (31) by means of a further surface machining using another machine tool.

6. The method according to claim 5, characterised in that the step of realising by moulding the first rough body (80) also comprises a step of realising said arched portion of the delivery conduit (6); the step of realising by moulding the first rough body (80) also comprising a step of realising an aspirating conduit (9) which conveys the fluid to be treated into the housing seating (3).

* * * * *